US006325049B1

(12) United States Patent
Nally

(10) Patent No.: US 6,325,049 B1
(45) Date of Patent: Dec. 4, 2001

(54) FUEL INJECTOR WITH ORIENTATION FEATURE FOR ORIENTING INJECTOR WITH RESPECT TO THE MANIFOLD OR HEAD

(75) Inventor: Debora Nally, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/339,280

(22) Filed: Jun. 23, 1999

(51) Int. Cl.[7] ..... F02M 55/02
(52) U.S. Cl. ..... 123/470
(58) Field of Search ..... 123/470, 472, 123/468, 469; 239/600, 533.1–533.12, 585.1–585.5

(56) References Cited

U.S. PATENT DOCUMENTS

| | | | | |
|---|---|---|---|---|
| 5,121,731 | | 6/1992 | Jones | 123/468 |
| 5,136,999 | | 8/1992 | Bassler et al. | 123/470 |
| 5,140,963 | | 8/1992 | Brackett et al. | 123/470 |
| 5,167,213 | | 12/1992 | Bassler et al. | 123/470 |
| 5,209,204 | | 5/1993 | Bodenhausen et al. | 123/470 |
| 5,211,149 | | 5/1993 | Degrace, Jr. | 123/470 |
| 5,226,391 | | 7/1993 | Gras et al. | 123/456 |
| 5,299,542 | | 4/1994 | Hafner | 123/470 |
| 5,520,151 | | 5/1996 | Gras et al. | 123/470 |
| 5,598,824 | | 2/1997 | Treusch et al. | 123/470 |
| 5,630,400 | * | 5/1997 | Sumida et al. | 123/470 |
| 5,706,787 | * | 1/1998 | Fujikawa | 123/470 |
| 5,794,856 | | 8/1998 | Nally | 239/408 |
| 5,803,052 | | 9/1998 | Lorraine et al. | 123/470 |

FOREIGN PATENT DOCUMENTS 2 083 862 A 3/1982 (GB) .

* cited by examiner

*Primary Examiner*—Henry C. Yuen
*Assistant Examiner*—Mahmoud Gimie

(57) ABSTRACT

A top feed fuel injector for an internal combustion engine includes a housing; a fuel passage within the housing; an electrically controlled valve mechanism for controlling fuel flow through the fuel passage; and a radially extending protrusion on the housing, the radially extending protrusion configured to mate with a void in a manifold or head in which the fuel injector is inserted such that the fuel injector maintains its orientation with respect to the manifold or head. Another aspect of the invention is a top feed fuel injector for an internal combustion engine including a housing; a fuel passage within the housing; and an electrically controlled valve mechanism for controlling fuel flow through the fuel passage; wherein the housing defines a radially inwardly extending opening, the radially inwardly extending opening configured to mate with a protrusion on a manifold or head in which the fuel injector is inserted such that the fuel injector maintains its orientation with respect to the manifold or head. The invention results in a more precise alignment of the injector fuel spray with respect to the intake valves.

17 Claims, 9 Drawing Sheets

FUEL INJECTOR WITH ORIENTATION FEATURE FOR ORIENTING INJECTOR WITH RESPECT TO THE MANIFOLD OR HEAD

BACKGROUND OF THE INVENTION

The invention relates in general to fuel injectors for internal combustion engines and in particular to fuel injectors that include an orientation feature for orienting the fuel injector with respect to the manifold or head of the engine.

Engine emission requirements have driven the need to achieve better targeting of the fuel spray as it exits a fuel injector. The ability to maintain a consistent and accurate fuel spray targeting at the intake valve depends, among other things, on the stack up of tolerances between the injector fuel orientation and the intake valves.

In the past, the feature that maintains orientation of top feed fuel injectors with respect to the intake valves was located at the fuel inlet end of the injector. Typically, the orientation feature was part of the overmold. The orientation feature on the overmold mated with an orienting clip. The orienting clip mated with an orienting cup on the fuel rail. Such an arrangement is shown, for example, in U.S. Pat. No. 5,803,052 issued on Sep. 8, 1998 to Lorraine et al. The aforementioned U.S. Patent is hereby expressly incorporated by reference.

Thus, in the prior art, the various tolerances between the injector fuel orientation and the intake valves included the tolerance on the injector between the fluid orienting disc and the fuel inlet end, the tolerance between the fuel inlet overmold and the clip, the tolerance between the clip and the rail cup, the tolerance between the rail cup and the rail body, the tolerance between the rail body and the brackets, the tolerance between the brackets and the screw, the tolerance between the screw and the hole in the manifold or head, and the tolerance between the screw hole boss and the intake valves.

Because of the large number of components and tolerances involved, it was difficult to obtain precise targeting of the fuel spray.

SUMMARY OF THE INVENTION

It is an object of the invention to provide an apparatus and method to minimize the variation in fuel spray targeting.

It is another object of the invention to provide an apparatus and method to decrease the number of components involved in orienting the fuel spray from a fuel injector.

It is a further object of the invention to provide an apparatus and method to decrease the tolerances involved in orienting the fuel spray from a fuel injector.

It is still a further object of the invention to provide an apparatus and method wherein the fuel injector is directly oriented to the manifold or head.

It is yet another object of the invention to provide an apparatus and method that results in a higher quality, more reliable fuel injector system.

These and other objects of the invention are achieved by a top feed fuel injector for an internal combustion engine comprising a housing; a fuel passage within the housing; an electrically controlled valve mechanism for controlling fuel flow through the fuel passage; and a radially extending protrusion on the housing, the radially extending protrusion configured to mate with a void in one of a manifold or head in which the fuel injector is inserted such that the fuel injector maintains an orientation with respect to the one of the manifold or head.

Another aspect of the invention is an apparatus comprising a fuel injector for an internal combustion engine, the fuel injector including a radially extending protrusion; and one of a manifold or head defining an opening into which the fuel injector is inserted, a wall of the opening defining a void for receiving the radially extending protrusion of the fuel injector such that the fuel injector is oriented with respect to the one of the manifold or head.

Another embodiment of the invention is a top feed fuel injector for an internal combustion engine comprising a housing; a fuel passage within the housing; and an electrically controlled valve mechanism for controlling fuel flow through the fuel passage; wherein the housing defines a radially inwardly extending opening, the radially inwardly extending opening configured to mate with a protrusion on one of a manifold or a head in which the fuel injector is inserted such that the fuel injector maintains an orientation with respect to the one of the manifold or head.

Yet another embodiment of the invention is an apparatus comprising a fuel injector for an internal combustion engine, the fuel injector including a housing defining a radially inwardly extending opening; and one of a manifold or head defining a second opening into which the fuel injector is inserted, a wall of the second opening including a radially extending protrusion which is inserted in the radially inwardly extending opening of the housing of the fuel injector such that the fuel injector maintains an orientation with respect to the one of the manifold or head.

The invention also encompasses a method comprising providing a fuel injector for an internal combustion engine, the fuel injector including a radially extending protrusion; providing one of a manifold or head defining an opening into which the fuel injector is inserted, a wall of the opening defining a void for receiving the radially extending protrusion of the fuel injector; inserting the fuel injector into the opening in the one of the manifold or head; and orienting the fuel injector with respect to the one of the manifold or head by inserting the radially extending protrusion of the fuel injector into the void in the wall of the opening.

A further method of the invention comprises providing a fuel injector for an internal combustion engine, the fuel injector including a housing defining a radially inwardly extending opening; providing one of a manifold or head defining a second opening into which the fuel injector is inserted, a wall of the second opening including a radially extending protrusion; inserted the fuel injector into the second opening; and orienting the fuel injector with respect to the one of the manifold or head by inserting the radially extending protrusion of the wall into the radially inwardly extending opening of the housing of the fuel injector.

Further objects, features and advantages of the invention will become apparent from the following detailed description taken in conjunction with the drawing.

DETAILED DESCRIPTION OF THE PREFERRED EMBODIMENTS

The present invention is an improved method and apparatus for maintaining a precise targeting of the fuel spray from a fuel injector in relation to the intake valves of an internal combustion engine. Because the intake valves are mounted in the head of the engine, the fuel spray is precisely maintained by maintaining the orientation of the fuel injector with respect to the head of the engine. In the present invention, the orientation of the fuel injector with respect to the head is accomplished by a "keying" arrangement. In one embodiment of the invention, the keying arrangement includes a protrusion on the fuel injector which mates with a corresponding void space located in one of the head or manifold of the engine. In another embodiment of the invention, the keying arrangement includes a protrusion on one of the manifold or head that mates with a corresponding void space on the fuel injector.

Figure 1:
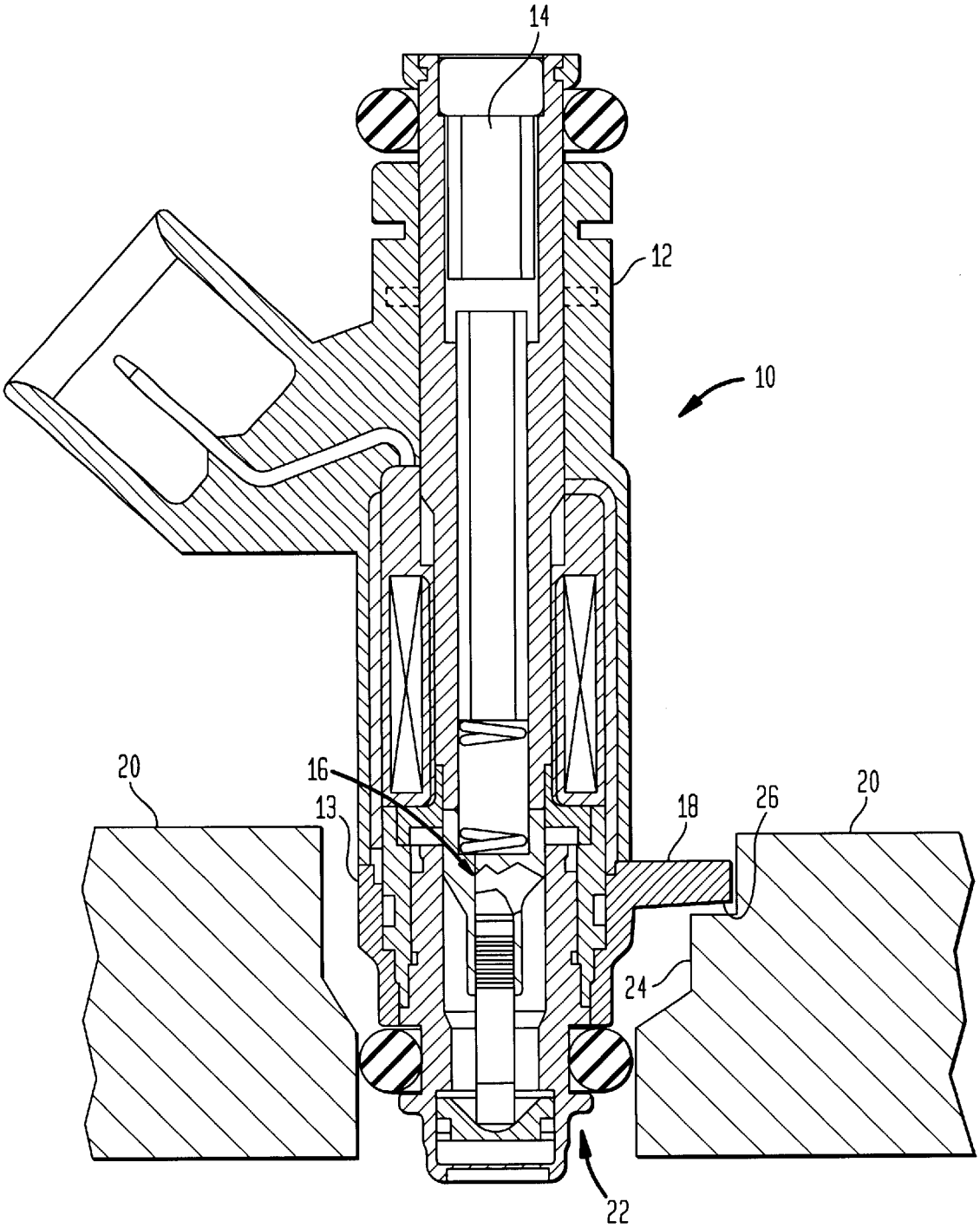
FIG. 1 is a cross-section of a first embodiment of a fuel injector and a manifold or head according to the present invention.

FIG. 1 shows a cross-section of a first embodiment of a fuel injector 10 and a manifold or head 20 according to the present invention. The fuel injector 10 is a top feed, non-air assist fuel injector. Fuel injector 10 includes a housing 12, a fuel passage 14 within the housing 12 and an electrically controlled valve mechanism 16 for controlling fuel flow through the fuel passage 14.

Housing 12 includes a radially extending protrusion 18 that is configured to mate with a void 26 in the manifold or head 20. The radially extending protrusion 18 is formed, for example, integrally molded, on the plastic shell 13. The plastic shell 13 is generally utilized for corrosion protection and O-ring back up. The plastic shell 13 is snapped or welded onto the injector 10.

The manifold or head 20 defines an opening 22 into which the injector 10 is inserted. A wall 24 of the opening 22 defines a void 26 for receiving the radially extending protrusion 18 of the injector. The injector 10 is inserted in the opening 22 in the manifold or head 20. The injector 10 is oriented with respect to the manifold or head 20 by inserting the radially extending protrusion 18 of the fuel injector into the void 26 in the wall 24 of the opening 22. The fit between the radially extending protrusion 18 and the void 26 may be up to an interference fit.

While reference numeral 20 indicates either a manifold or head, in a preferred embodiment, the injector 10 is inserted and oriented in a head. Because the intake valves are in the head, a more precise orientation of the injector with respect to the intake valves is accomplished when the injector is inserted and oriented directly in the head. However, it is also possible that the injector may be inserted and oriented in the manifold. Insertion and orientation in the manifold, while not as preferred as insertion and orientation in the head, is still an improvement over prior methods of orienting the injector.

The head is usually made of a metallic material and the manifold may be a metal, plastic or a composite material.

Figure 2:
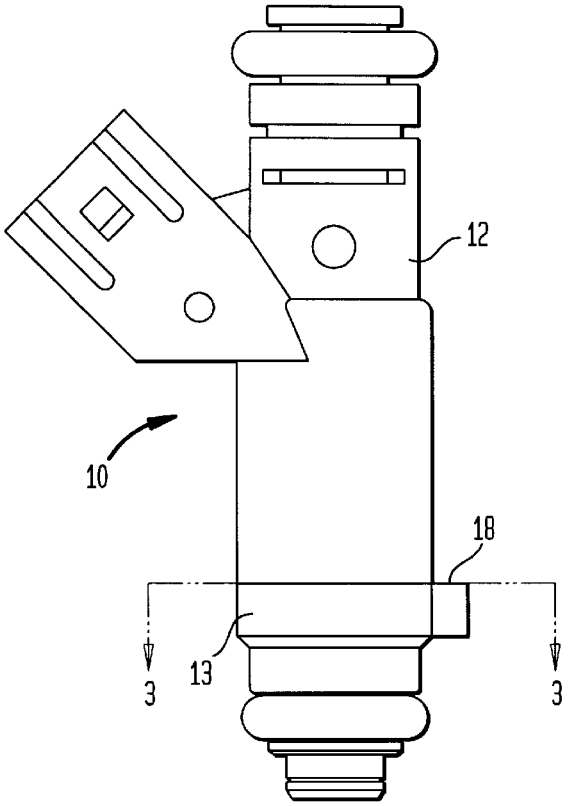
FIG. 2 is a side view of the fuel injector of FIG. 1.
Figure 3A:
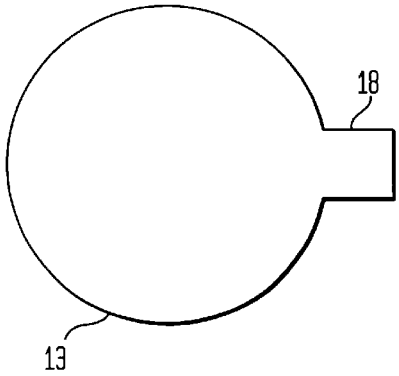
FIG. 3A is a schematic top view of the plane 3—3 marked in FIG. 2.

FIG. 2 is a side view of the fuel injector 10 of FIG. 1 showing the radially extending protrusion 18. FIG. 3A is a schematic top view of the plane 3—3 marked in FIG. 2.

Figure 3B:
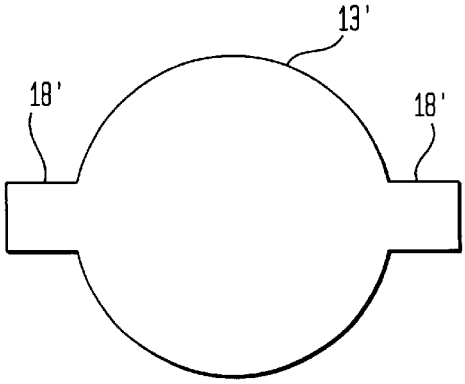
FIG. 3B is a schematic top view of the plane 3—3 showing a second embodiment of the fuel injector according to the invention.

FIG. 3B is a schematic top view of the plane 3—3 showing a second embodiment of the fuel injector according to the invention. In FIG. 3B, the shell 13' includes two radially extending protrusions 18'. Of course, the manifold or head 20 would include two voids 26 for receiving the protrusions 18'.

Figure 3C:
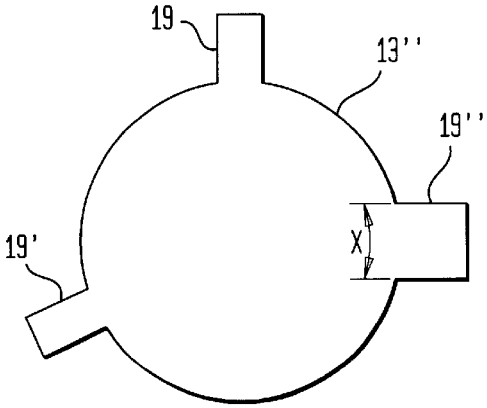
FIG. 3C is aschematic top view of the plane 3—3 showing a third embodiment of the fuel injector to the invention.

FIG. 3C is a schematic top view of the plane 3—3 showing a third embodiment of the fuel injector according to the invention. In FIG. 3C, the shell 13" includes three radially extending protrusions 19,19' and 19". "X" denotes the angular circumferential extent of protrusion 19". The circumferential extent of the protrusions 19,19' and 19" may be the same or different and the protrusions may be spaced either equally or unequally about the circumference of the shell 13". The manifold or head would include a like number of voids 26 for receiving the protrusions 19,19' and 19". Furthermore, it is possible to have more than three protrusions.

The radially extending protrusions 18,18', 19,19' and 19" may each have a circumferential extent of about 2 to about 180 degrees. Also, varying shapes and sizes of the radially extending protrusions are possible. It is only necessary that the protrusion provide the structural strength necessary to maintain the orientation of the fuel injector with respect to the manifold or head 20.

Figure 4:
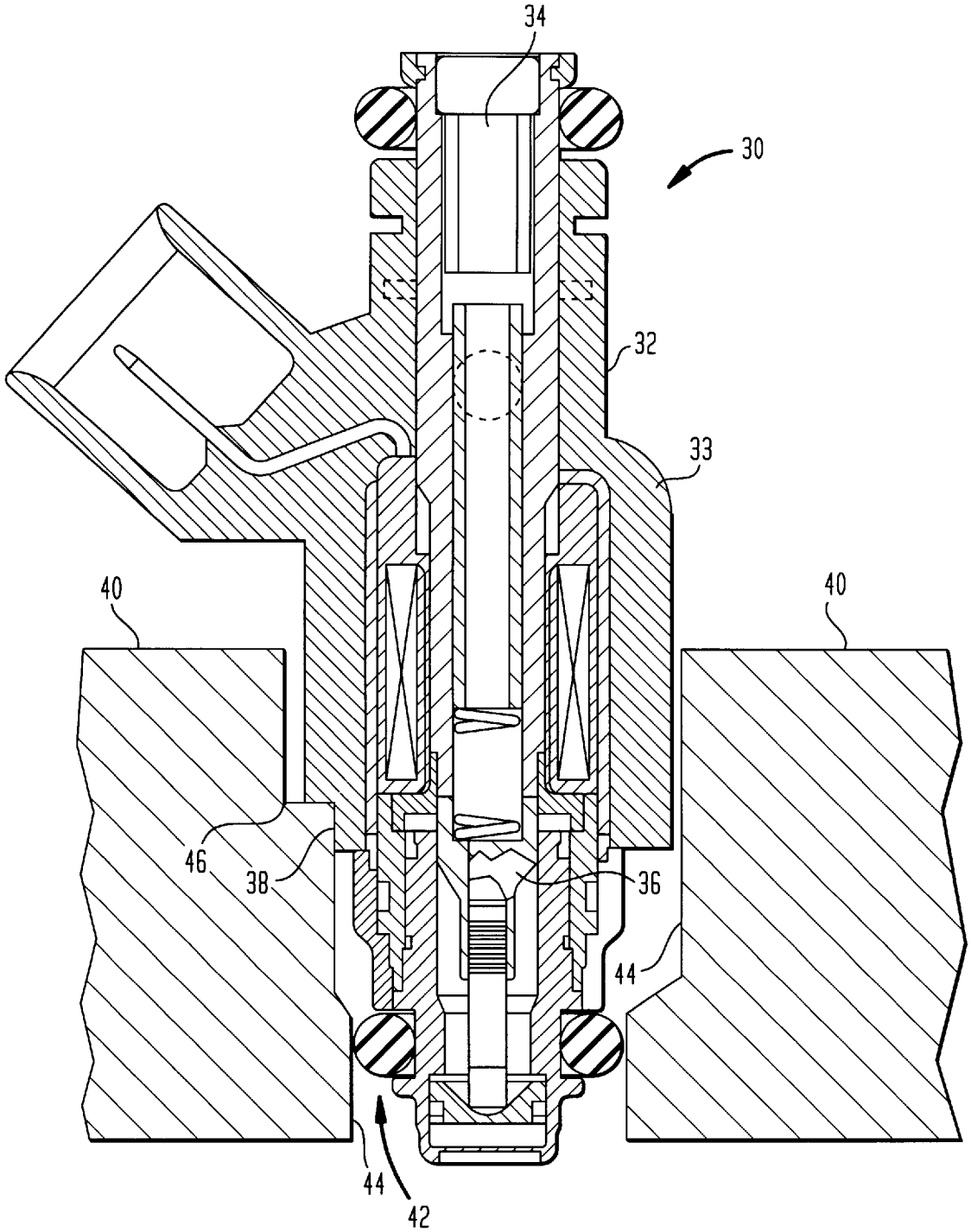
FIG. 4 is a cross-section of a fourth embodiment of a fuel injector and a manifold or head according the present invention.

FIG. 4 is a cross-section of a fourth embodiment of a fuel injector 30 and a manifold or head 40 according to the present invention. The fuel injector 30 is a top feed, non-air assist fuel injector. Fuel injector 30 includes a housing 32, a fuel passage 34 within the housing 32 and an electrically controlled valve mechanism 36 for controlling fuel flow through the fuel passage 34.

Housing 32 includes an overmold 33 generally made of a plastic material. The overmold 33 is thicker than a conventional overmold to thereby accommodate a radially inwardly extending opening 38 that is configured to mate with a protrusion 46 in the manifold or head 40. The radially inwardly extending opening 38 is formed, for example, integrally molded, with the overmold 33.

The manifold or head 40 defines an opening 42 into which the injector 30 is inserted. A wall 44 of the opening 42 defines a protrusion 46 for insertion into the radially inwardly extending opening 38 of the injector. The injector 30 is inserted in the opening 42 in the manifold or head 40. The injector 30 is oriented with respect to the manifold or head 40 by inserting the protrusion 46 of the manifold or head 40 into the radially inwardly extending opening 38 of the injector 30. The fit between the radially inwardly extending opening 38 and the protrusion 46 may be up to an interference fit.

While reference numeral 40 indicates either a manifold or head, in a preferred embodiment, the injector 30 is inserted and oriented in a head for the same reasons as discussed above with regard to FIG. 1. Throughout all the disclosed embodiments, the head is usually made of a metallic material and the manifold may be a metal, plastic or a composite material.

Figure 5:
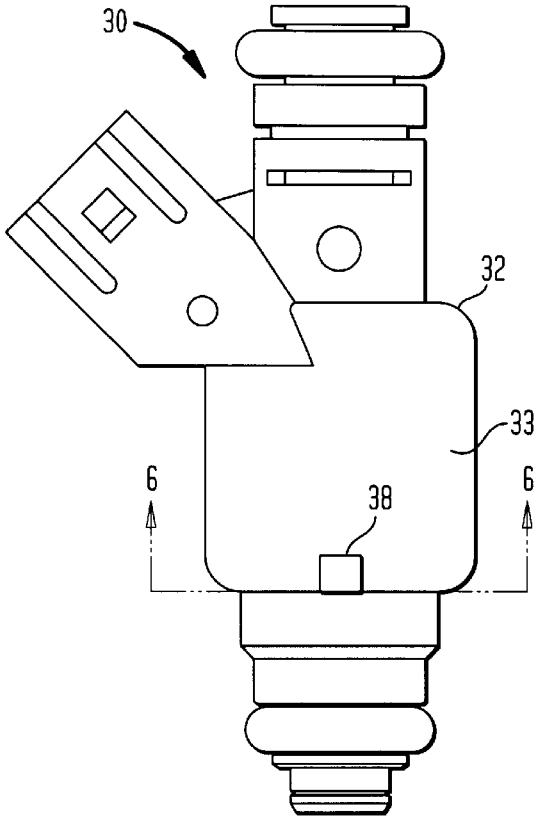
FIG. 5 is a view of the fuel injector of FIG. 4.
Figure 6A:
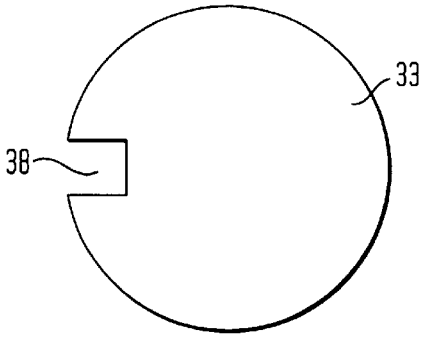
FIG. 6A is a schematic bottom view of the plane 6—6 marked in FIG. 5.

FIG. 5 is a front view of the fuel injector of FIG. 4 showing the opening 38. FIG. 6A is a schematic bottom view of the plane 6—6 marked in FIG. 5.

Figure 6B:
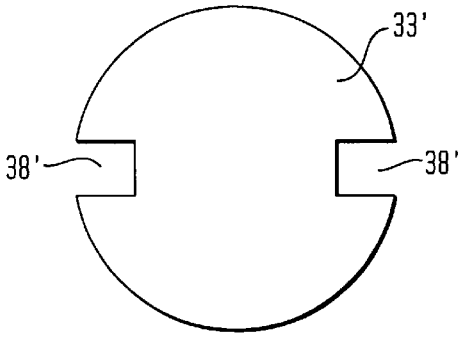
FIG. 6B is a schematic bottom view of the plane 6—6 showing a fifth embodiment of the fuel injector according to the invention.

FIG. 6B is a schematic bottom view of the plane 6—6 showing a fifth embodiment of the fuel injector according to the invention. In FIG. 6B, two radially inwardly extending openings 38' are formed in the overmold 33'. Of course, the manifold or head 40 would include two protrusions 46 for insertion in the openings 38'.

Figure 6C:
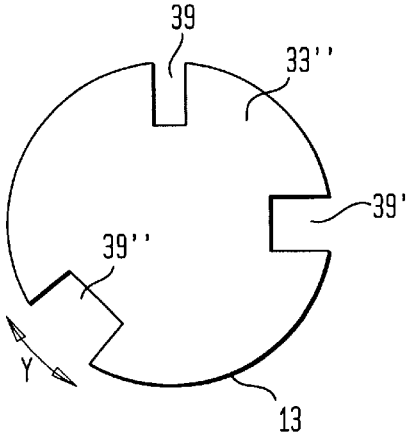
FIG. 6C is a schematic bottom view of the plane 6—6 showing a sixth embodiment of the fuel injector according to the invention.

FIG. 6C is a schematic bottom view of the plane 6—6 showing a sixth embodiment of the fuel injector according to the invention. FIG. 6C shows an overmold 33" having three radially inwardly extending openings 39,39' and 39". "Y" denotes the angular circumferential extent of opening 39". The circumferential extent of the openings 39,39' and 39" may be the same or different and the openings may be spaced either equally or unequally about the circumference of the overmold 33". The manifold or head would include a like number of protrusions 46 for insertion into the openings 39,39' and 39". Furthermore, it is possible to have more than three openings.

The openings 38,38', 39,39' and 39" may each have a circumferential extent of about 2 to about 180 degrees. Also, varying shapes and sizes of the openings are possible. It is only necessary that the protrusion 46, when inserted into the opening 38, provide the structural strength necessary to maintain the orientation of the fuel injector with respect to the manifold or head 40.

Figure 7:
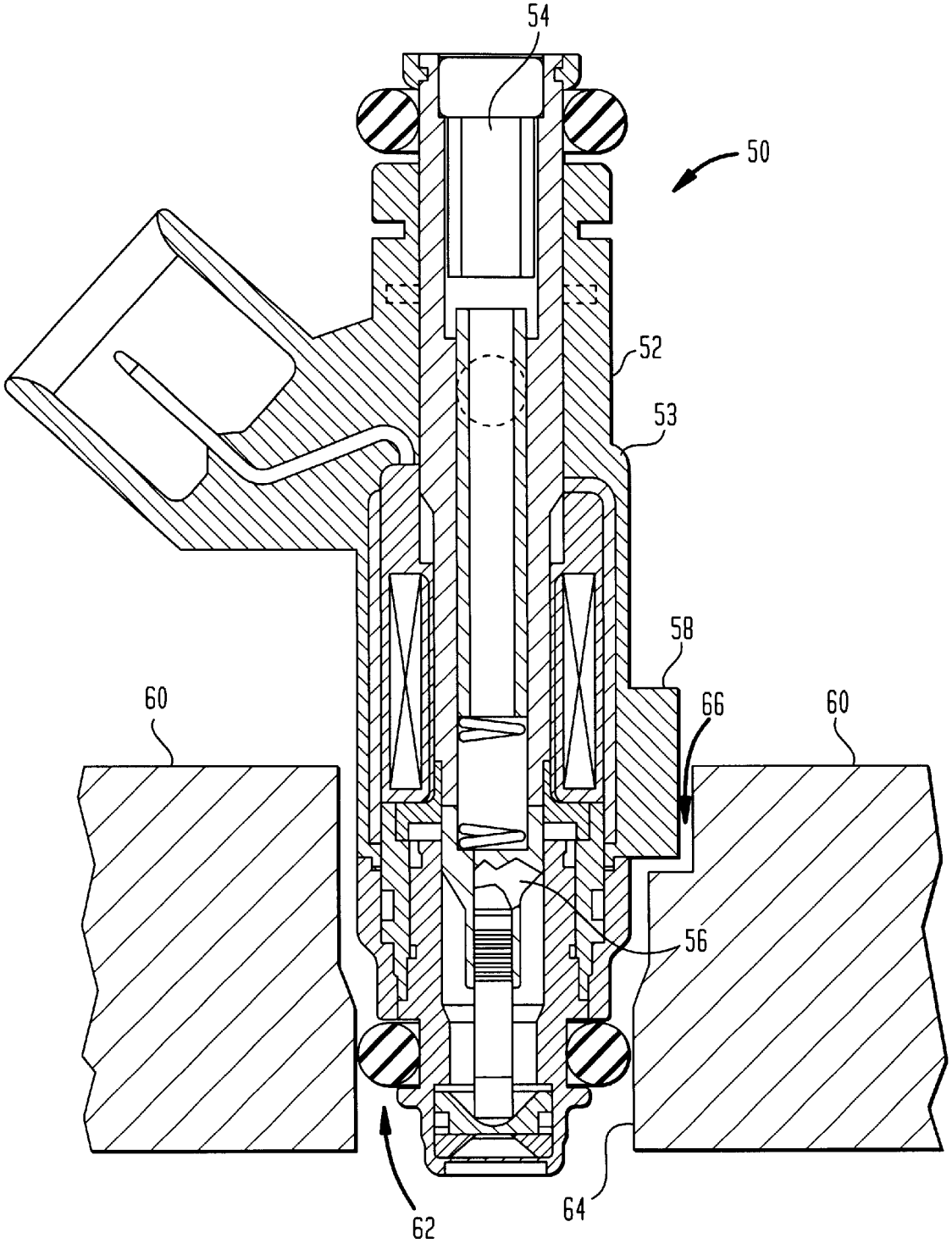
FIG. 7 is a cross-section of a seventh embodiment of a fuel injector and a manifold or head according to the present invention.

FIG. 7 is a cross-section of a seventh embodiment of a fuel injector 50 and a manifold or head 60 according to the present invention. The fuel injector 50 is a top feed, non-air assist fuel injector. Fuel injector 50 includes a housing 52, a fuel passage 54 within the housing 52 and an electrically controlled valve mechanism 56 for controlling fuel flow through the fuel passage 54.

Housing 52 includes an overmold 53 having a radially extending protrusion 58 that is configured to mate with a void 66 in the manifold or head 60. The radially extending protrusion 58 is formed, for example, integrally molded, on a lower portion of the plastic overmold 53.

The manifold or head 60 defines an opening 62 into which the injector 50 is inserted. A wall 64 of the opening 62 defines a void 66 for receiving the radially extending protrusion 58 of the injector. The injector 50 is inserted in the opening 62 in the manifold or head 60. The injector 60 is oriented with respect to the manifold or head 60 by inserting the radially extending protrusion 58 of the fuel injector into the void 66 in the wall 64 of the opening 62. The fit between the radially extending protrusion 58 and the void 66 may be up to an interference fit.

While reference numeral 60 indicates either a manifold or head, in a preferred embodiment, the injector 50 is inserted and oriented in a head.

Figure 9:
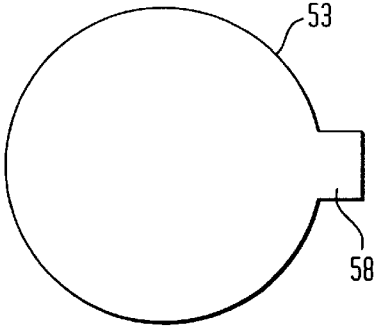
FIG. 9 is a schematic top view of the plane 9—9 marked in FIG. 8.
Figure 8:
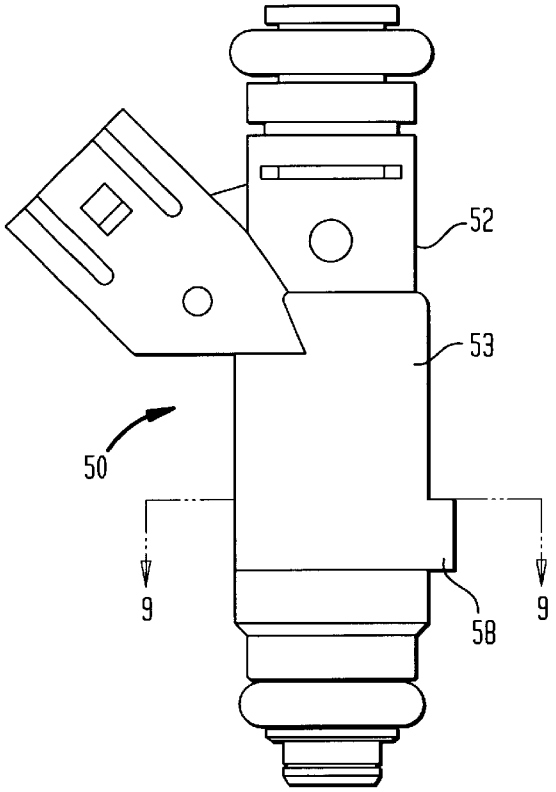
FIG. 8 is a side view of the fuel injector of FIG. 7.

FIG. 8 is a side view of the fuel injector of FIG. 7 showing the radially extending protrusion 58. FIG. 9 is a schematic top view of the plane 9—9 marked in FIG. 8. In a similar manner as discussed above with regard to FIGS. 3A, 3B and 3C, additional protrusions 58 could be added to the overmold 53. The additional protrusions could be of the same or a different circumferential extent as the projection 58. The additional protrusions could be spaced equally or unequally about the circumference of the overmold 53. Of course, for each additional protrusion, the manifold or head 60 would include a corresponding void 66 to accommodate each protrusion.

Figure 10:
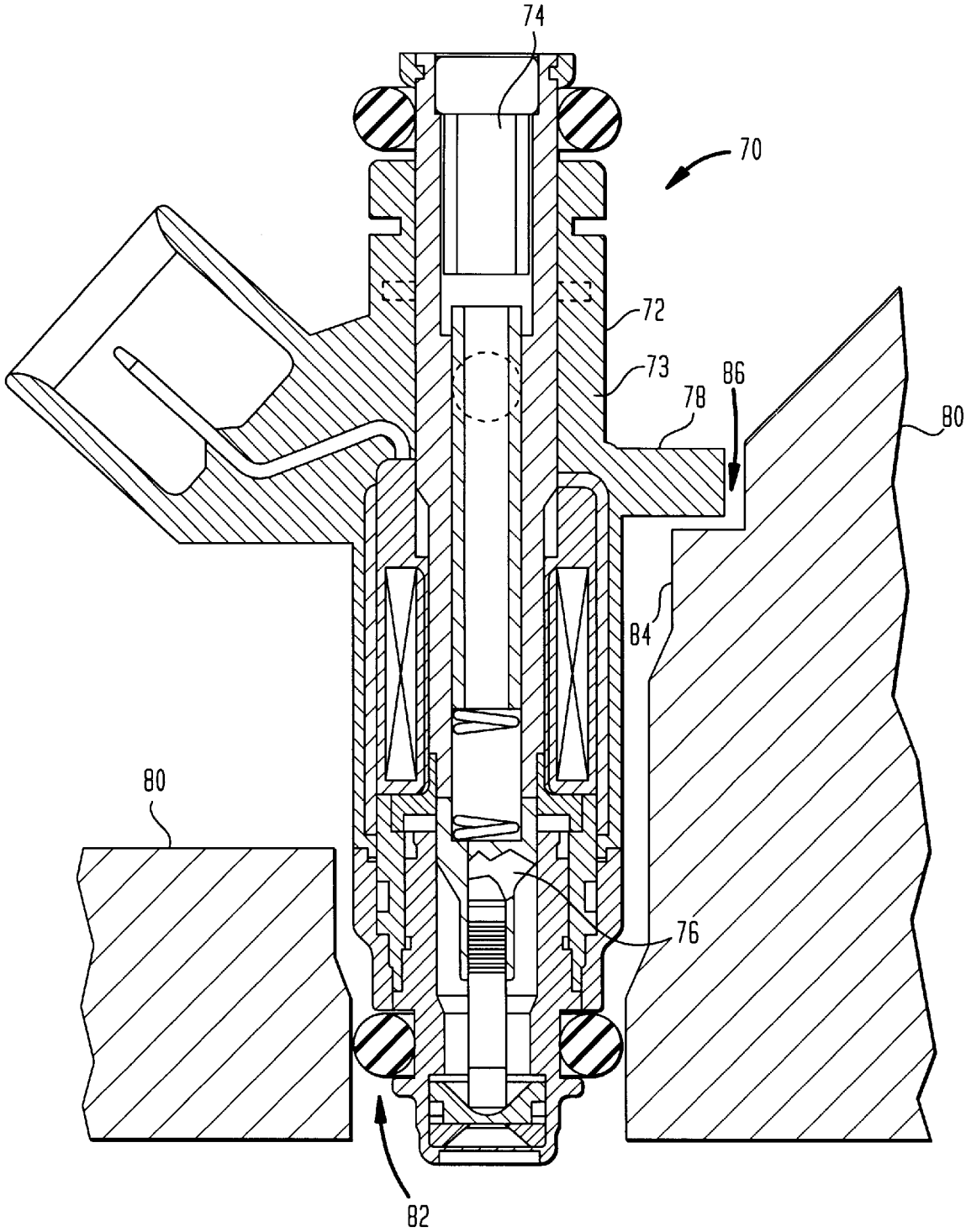
FIG. 10 is a cross-section of an eighth embodiment of a fuel injector and a manifold or head according to the present invention.

FIG. 10 is a cross-section of an eighth embodiment of a fuel injector 70 and a manifold or manifold air runner 80 according to the present invention. The fuel injector 70 is a top feed, non-air assist fuel injector. Fuel injector 70 includes a housing 72, a fuel passage 74 within the housing 72 and an electrically controlled valve mechanism 76 for controlling fuel flow through the fuel passage 74.

Housing 72 includes an overmold 73 having on an upper portion thereof a radially extending protrusion 78 that is configured to mate with a void 86 in the manifold or manifold air runner 80. The radially extending protrusion 78 is formed, for example, integrally molded, on an upper portion of the plastic overmold 73.

The manifold or manifold air runner 80 defines an opening 82 into which the injector 80 is inserted. A wall 84 of the opening 82 defines a void 86 for receiving the radially extending protrusion 78 of the injector. The injector 70 is inserted in the opening 72 in the manifold or manifold air runner 80. The injector 70 is oriented with respect to the manifold or manifold air runner 80 by inserting the radially extending protrusion 78 of the fuel injector into the void 86 in the wall 84 of the opening 82. The fit between the radially extending protrusion 78 and the void 86 may be up to an interference fit.

Figure 11:
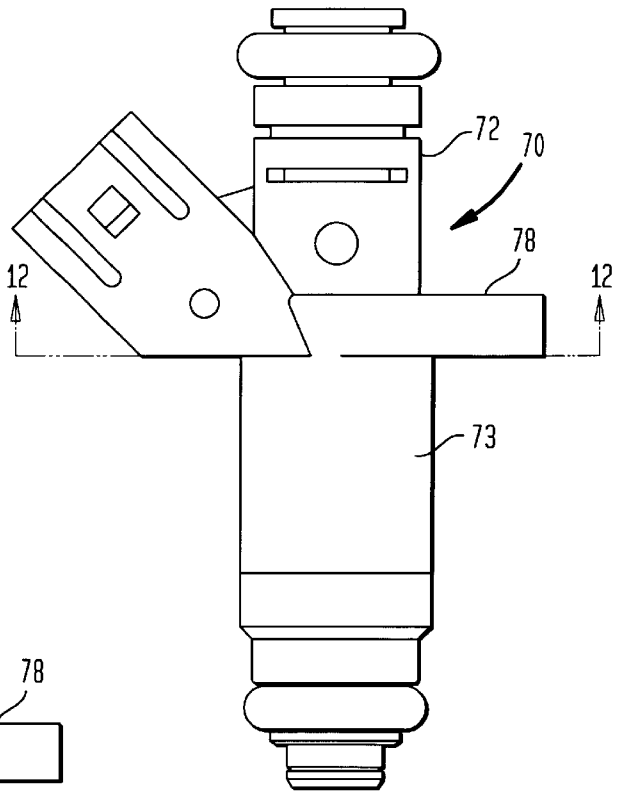
FIG. 11 is a side view of the fuel injector of FIG. 10.
Figure 12:
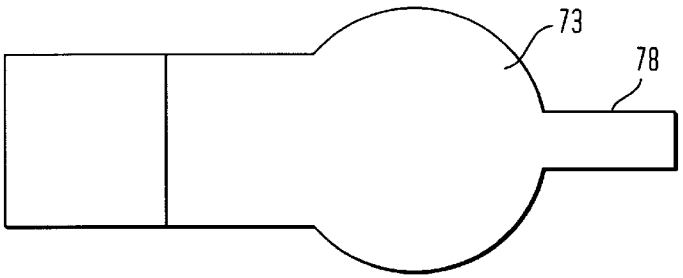
FIG. 12 is a schematic bottom view of the plane 12—12 marked in FIG. 11.

FIG. 11 is a side view of the fuel injector of FIG. 10 showing the radially extending protrusion 78. FIG. 12 is a schematic bottom view of the plane 12—12 marked in FIG. 11. The radially extending protrusion 78 may have a circumferential extent of about 2 to about 180 degrees. Also, varying shapes and sizes of the radially extending protrusion are possible. It is only necessary that the protrusion 78 provide the structural strength necessary to maintain the orientation of the fuel injector with respect to the manifold or manifold air runner 80. Also, multiple protrusions 78 and corresponding voids 86 are possible and contemplated by the invention.

While the invention so far has been disclosed with reference to non-air assist fuel injectors, the invention is also applicable to air assist injectors. An exemplary air assist injector is shown and described in U.S. Pat. No. 5,794,856 (the '856 patent) issued on Aug. 18, 1998 to Debora Nally and entitled "Air Assist Injector and Retainer Shroud Therefor." The '856 patent is hereby expressly incorporated by reference.

Figure 13:
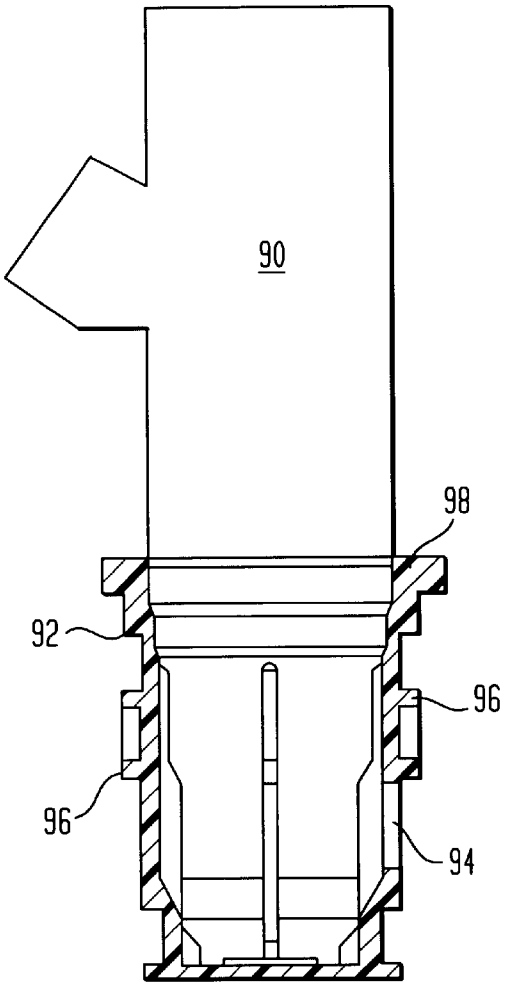
FIG. 13 is a partial cross-section of an air assist injector.

FIG. 13 is a partial cross-section of an air assist injector 90. Only the retainer shroud 92 is shown in section. The construction and arrangement of the fuel injector 90 is described in detail in the '856 patent, referenced above. The retainer shroud 92 includes air passage 94, locator tabs 96 and upper flange 98. The retainer shroud 92 is preferably an integrally molded plastic piece.

Figure 14:
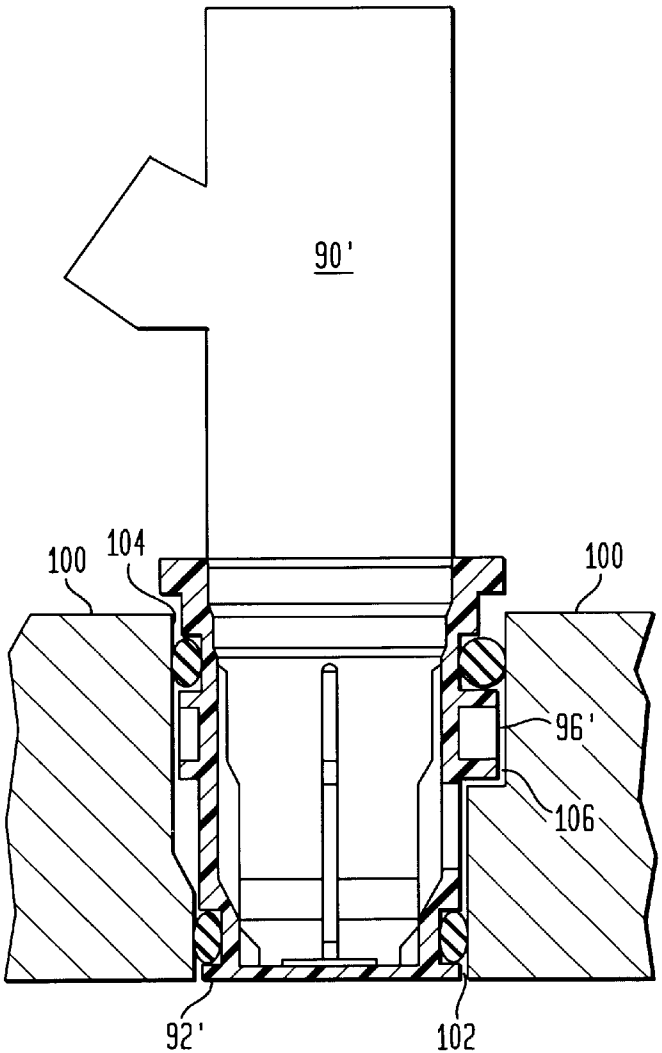
FIG. 14 is a partial cross-section of a ninth embodiment of a fuel injector and a manifold or head according to the invention.

FIG. 14 shows an air assist injector 90' oriented in a manifold or head 100. The injector 90' includes a retainer shroud 92'. The retainer shroud 92' differs from the retainer shroud 92 because one of the locator tabs 96 has been extended to form a radially extending protrusion 96'. The radially extending protrusion 96' is configured to mate with a void 106 in the manifold or head 100. The radially extending protrusion 96' is formed, for example, by integral molding, on the retainer shroud 92'.

The manifold or head 100 defines an opening 102 into which the injector 90' is inserted. A wall 104 of the opening 102 defines a void 106 for receiving the radially extending protrusion 96' of the injector. The injector 90' is inserted in the opening 102 in the manifold or head 100. The injector 90' is oriented with respect to the manifold or head 100 by inserting the radially extending protrusion 96' of the fuel injector into the void 106 in the wall 104 of the opening 102. The fit between the radially extending protrusion 96' and the void 106 may be up to an interference fit. Multiple protrusions 96' and corresponding voids 106 are possible and contemplated by the invention.

Figure 15:
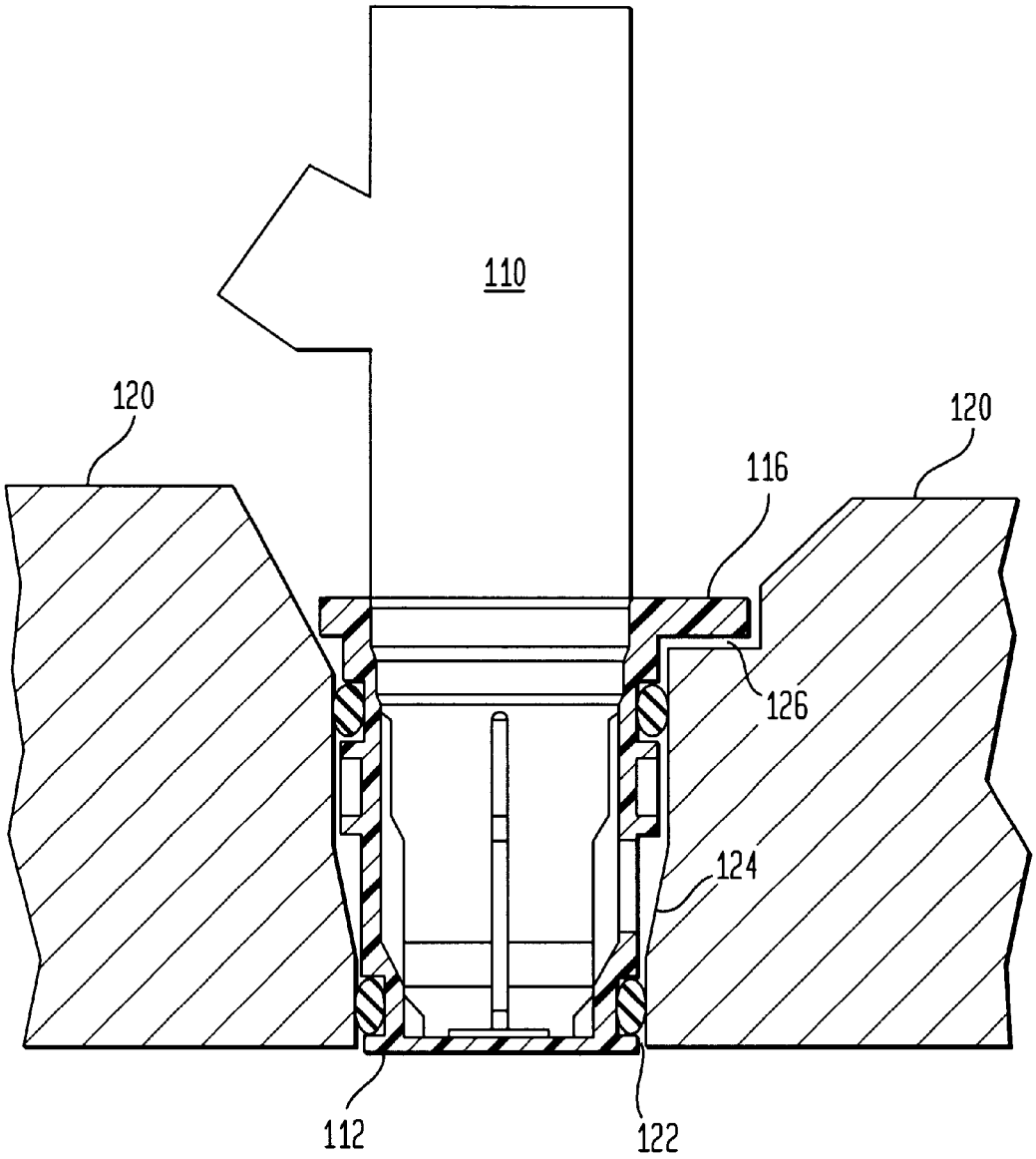
FIG. 15 is a partial cross-section of a embodiment fuel injector and a manifold or head according to the invention.

FIG. 15 shows an air assist injector 110 oriented in a manifold or head 120. The injector 110 includes a retainer shroud 112. The retainer shroud 112 differs from the retainer shroud 92 of FIG. 13 because a portion of the flange 98 has been extended to form a radially extending protrusion 116. The radially extending protrusion 116 is configured to mate with a void 126 in the manifold or head 120. The radially extending protrusion 126 is formed, for example, by integral molding, on the retainer shroud 112.

The manifold or head 120 defines an opening 122 into which the injector 110 is inserted. A wall 124 of the opening 122 defines a void 126 for receiving the radially extending protrusion 116 of the injector. The injector 110 is inserted in the opening 122 in the manifold or head 120. The injector 110 is oriented with respect to the manifold or head 120 by inserting the radially extending protrusion 116 of the fuel injector into the void 126 in the wall 124 of the opening 122. The fit between the radially extending protrusion 116 and the void 126 may be up to an interference fit. Multiple protrusions 116 having the same or different circumferential extents and corresponding voids 126 are possible and contemplated by the invention.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A top feed fuel injector for an internal combustion engine, comprising:

a housing extending along a longitudinal axis;

a fuel passage within the housing;

an electrically controlled valve mechanism for controlling fuel flow through the fuel passage; and a radially extending protrusion on the housing, the radially extending protrusion configured to mate with a void in one of a manifold or head in which the fuel injector is inserted such that the fuel injector maintains an angular orientation about the longitudial axis with respect to the one of the manifold or head.

2. The fuel injector of claim 1 wherein the radially extending protrusion is located on a lower portion of the housing.

3. The fuel injector of claim 1 wherein the radially extending protrusion is located on an upper portion of the housing.

4. The fuel injector of claim 1 wherein the housing includes an overmold and the radially extending protrusion is located on the overmold.

5. The fuel injector of claim 4 wherein the fuel injector is a non-air assist injector.

6. The fuel injector of claim 4 wherein the fuel injector is an air assist injector.

7. The fuel injector of claim 5 wherein the housing includes a lower shell and the radially extending protrusion is located on the lower shell.

8. The fuel injector of claim 6 wherein the housing includes a retainer shroud and the radially extending protrusion is located on the retainer shroud.

9. A top feed fuel injector for an internal combustion engine, comprising:

a housing;

a fuel passage within the housing; and an electrically controlled valve mechanism for controlling fuel flow through the fuel passage;

wherein the housing defines a radially inwardly extending opening, the radially inwardly extending opening configured to mate with a protrusion on one of a manifold or a head in which the fuel injector is inserted such that the fuel injector maintains an orientation with respect to the one of the manifold or head.

10. The fuel injector of claim 9 wherein the radially inwardly extending opening is located on a lower portion of the housing.

11. The fuel injector of claim 9 wherein the radially inwardly extending opening is located on an upper portion of the housing.

12. The fuel injector of claim 9 wherein the housing includes an overmold and the radially inwardly extending opening is located on the overmold.

13. The fuel injector of claim 12 wherein the fuel injector is a non-air assist injector.

14. The fuel injector of claim 12 wherein the fuel injector is an air assist injector.

15. The fuel injector of claim 13 wherein the housing includes a lower shell and the radially inwardly extending opening is located on the lower shell.

16. The fuel injector of claim 14 wherein the housing includes a retainer shroud and the radially inwardly extending opening is located on the retainer shroud.

17. A method comprising:

providing a fuel injector for an internal combustion engine, the fuel injector extending along a longitudinal axis and including a radially extending protrusion;

providing one of a manifold or head defining an opening into which the fuel injector is inserted, a wall of the opening defining a void for receiving the radially extending protrusion of the fuel injector;

inserting the fuel injector into the opening in the one of the manifold or head; and angularly orienting the fuel injector about the longtudinal axis with respect to the one of the manifold or head by inserting the radially extending protrusion of the fuel injector into the void in the wall of the opening.

* * * * *